US006786342B2

(12) United States Patent
Tayebi

(10) Patent No.: US 6,786,342 B2
(45) Date of Patent: Sep. 7, 2004

(54) TOOTHBRUSH HOLDER AND A METHOD FOR ASSURING THE HYGIENE OF A TOOTHBRUSH HOLDER AND FOR ADAPTING A TOOTHBRUSH HOLDER TO PROVIDE ASSURANCE OF ITS HYGIENE

(76) Inventor: Amad Tayebi, 5 Sequoia Rd., Westford, MA (US) 01886

( * ) Notice: Subject to any disclaimer, the term of this patent is extended or adjusted under 35 U.S.C. 154(b) by 0 days.

(21) Appl. No.: 10/209,381

(22) Filed: Jul. 31, 2002

(65) Prior Publication Data

US 2003/0034315 A1 Feb. 20, 2003

Related U.S. Application Data

(60) Provisional application No. 60/309,066, filed on Jul. 31, 2001.

(51) Int. Cl.[7] ..... A47B 81/02

(52) U.S. Cl. ..... 211/65; 211/119.009; 211/73; 248/110

(58) Field of Search ..... 211/72.73, 71.01, 211/119.009, 65, 66, 60.1, 13.1, 70.7; 248/110, 111; D6/524, 528, 534; 220/736; 312/206

(56) References Cited

U.S. PATENT DOCUMENTS

| | | | | | |
|---|---|---|---|---|---|
| 1,356,487 | A | * | 10/1920 | Cluxton | 211/65 |
| 1,487,085 | A | * | 3/1924 | Blackshear | 211/65 |
| D65,892 | S | * | 11/1924 | Baker | D6/528 |
| 1,551,434 | A | * | 8/1925 | Shiffer | 211/65 |
| D148,431 | S | * | 1/1948 | Lund | D28/74 |
| 2,477,274 | A | * | 7/1949 | Trecek | 206/756 |
| 2,642,999 | A | * | 6/1953 | McPherson | 211/65 |
| D176,162 | S | * | 11/1955 | Steece | D6/528 |
| 2,916,155 | A | * | 12/1959 | Elliott | 211/65 |
| 2,917,182 | A | * | 12/1959 | Browne | 211/65 |
| 3,002,630 | A | * | 10/1961 | Heisser | 211/65 |
| 3,233,743 | A | * | 2/1966 | Di Tirro | 211/65 |
| 3,344,930 | A | * | 10/1967 | Merkel | 211/65 |
| D215,100 | S | * | 9/1969 | Seller | D6/528 |
| 3,964,709 | A | * | 6/1976 | LaBelle et al. | 248/133 |
| 4,008,808 | A | * | 2/1977 | Ramsay | 211/65 |
| D250,305 | S | * | 11/1978 | Primiano et al. | D6/574 |
| 4,488,327 | A | * | 12/1984 | Snider | 15/111 |
| D278,777 | S | * | 5/1985 | Martin | D6/534 |
| 4,515,334 | A | * | 5/1985 | Horne | 248/146 |
| 4,607,752 | A | * | 8/1986 | Sherrow | 211/65 |
| 4,770,379 | A | * | 9/1988 | Estvold | 248/110 |
| D304,421 | S | * | 11/1989 | Holdaway | D8/37 |
| D306,811 | S | * | 3/1990 | DeLeon | D6/531 |
| 4,979,708 | A | * | 12/1990 | Aoki | 248/110 |
| D320,123 | S | * | 9/1991 | Wolf et al. | D6/528 |
| 5,180,066 | A | * | 1/1993 | McArdle | 211/74 |
| 5,259,519 | A | * | 11/1993 | Lieberman | 211/66 |
| 5,358,127 | A | * | 10/1994 | Ennis | 211/60.1 |
| D363,365 | S | * | 10/1995 | Beaudoin et al. | D28/73 |
| 5,769,245 | A | * | 6/1998 | Butler | 211/65 |
| 5,996,816 | A | * | 12/1999 | Bernard | 211/65 |
| D425,349 | S | * | 5/2000 | Adkins | D6/528 |
| 6,102,203 | A | * | 8/2000 | Marro | 206/362.1 |
| 6,325,222 | B1 | * | 12/2001 | Avery et al. | 211/65 |
| 6,357,713 | B1 | * | 3/2002 | BeBow | 248/300 |
| 6,497,236 | B1 | * | 12/2002 | Yates et al. | 132/309 |

FOREIGN PATENT DOCUMENTS

| | | | | |
|---|---|---|---|---|
| GB | 2232581 | A | * 12/1990 | 211/65 |

* cited by examiner

*Primary Examiner*—Jennifer E. Novosad

(57) ABSTRACT

A counter-top toothbrush holder for holding a toothbrush in a stable equilibrium position. The holder comprises a base and an elevator section which is connected to the base and extends upwardly from the base. The elevator section has a receptacle member which has at least one open-type receptacle. The receptacle is adapted to receive and hold a toothbrush in a stable equilibrium position.

5 Claims, 4 Drawing Sheets

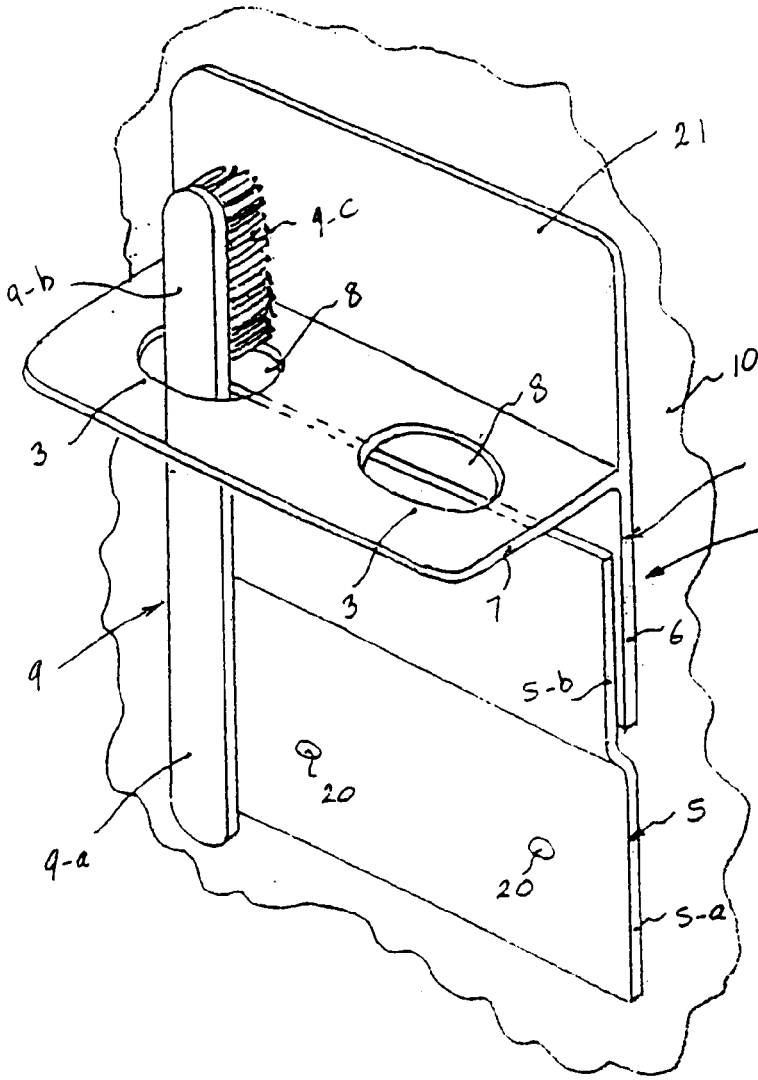
Figure (1)
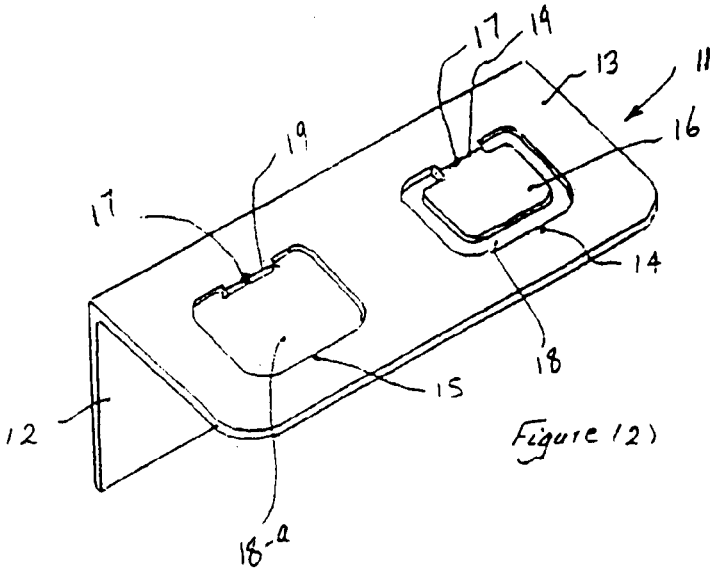
Figure (2)

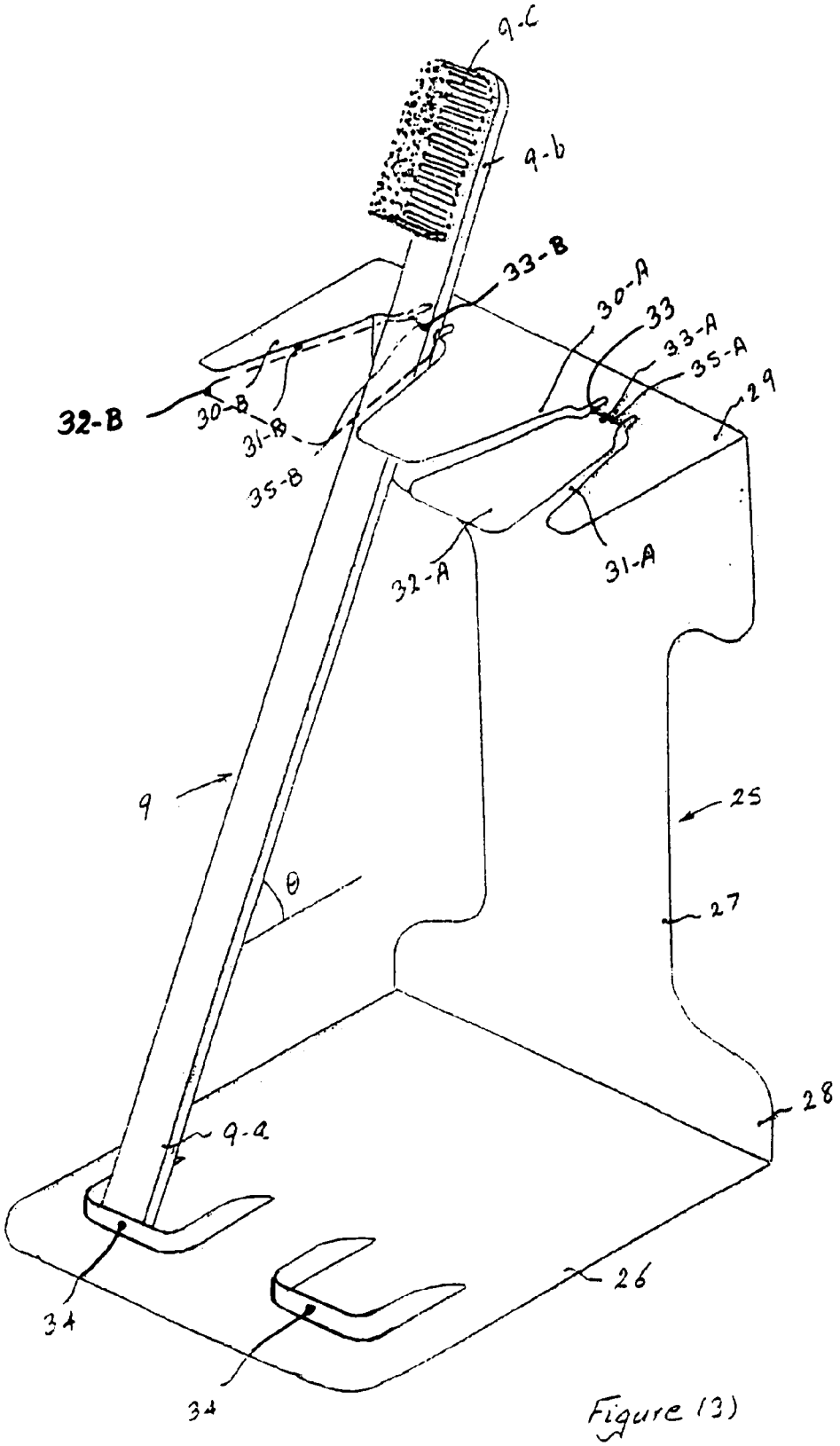
Figure (3)

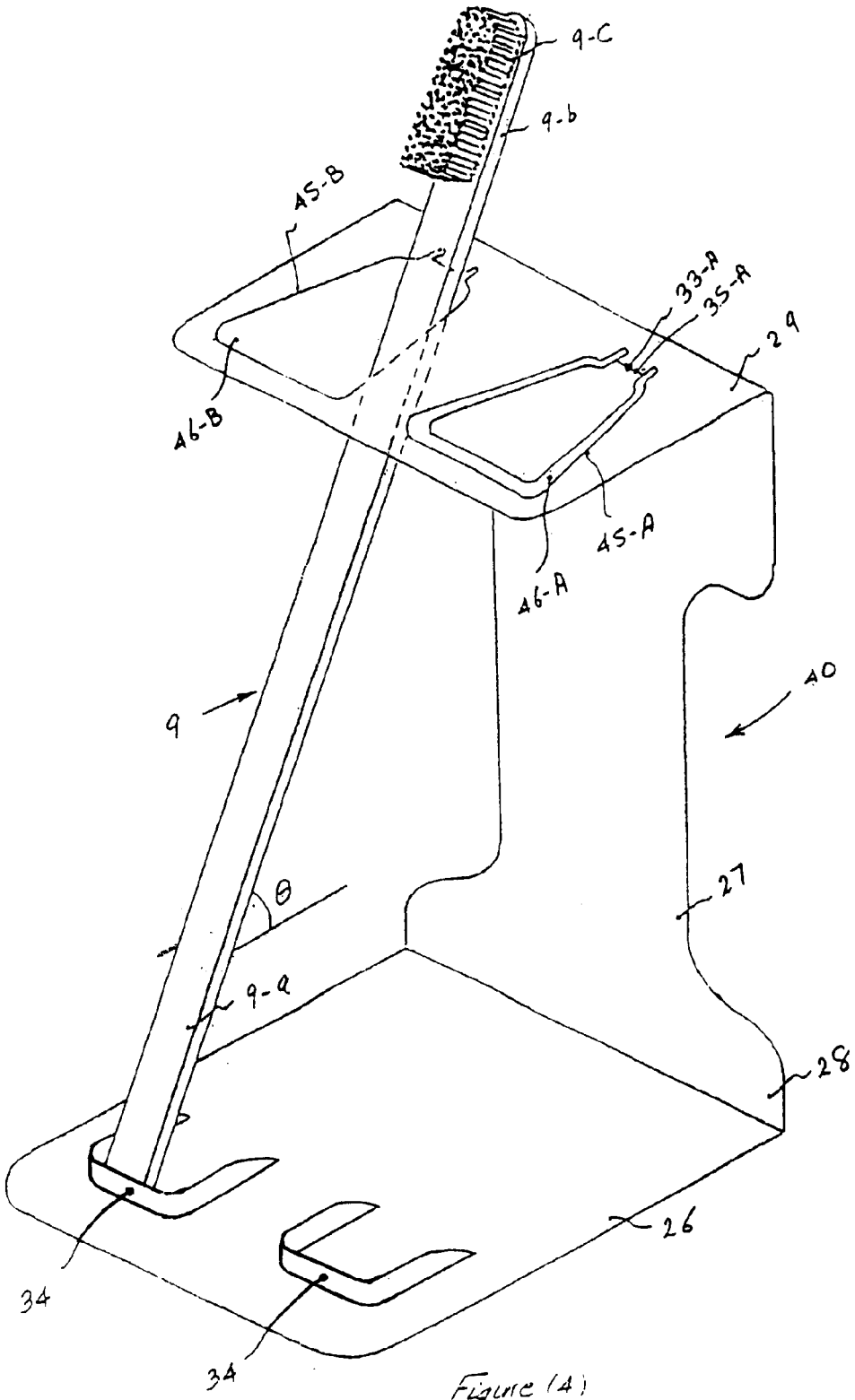
Figure (4)

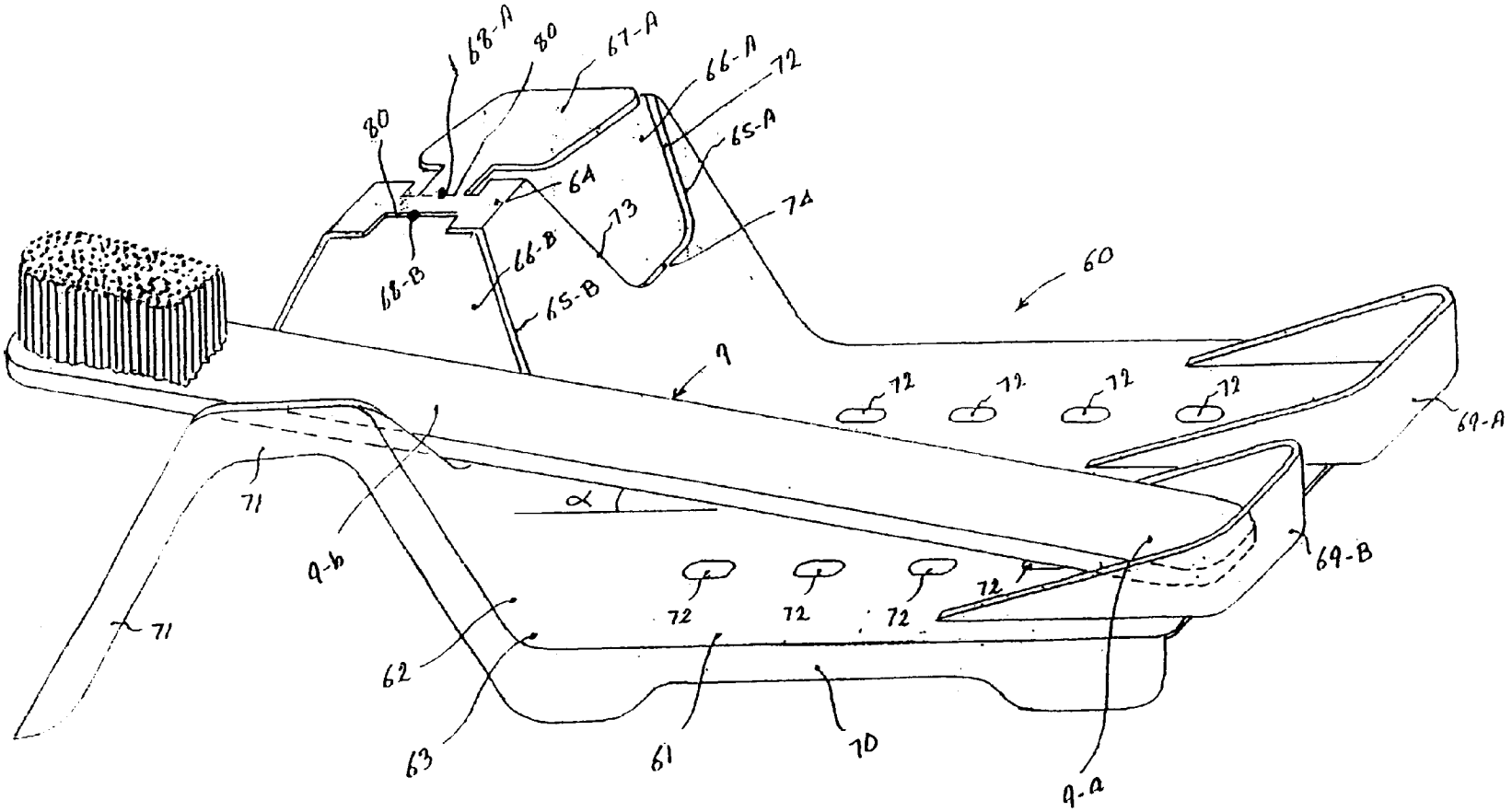
Figure (5)

TOOTHBRUSH HOLDER AND A METHOD FOR ASSURING THE HYGIENE OF A TOOTHBRUSH HOLDER AND FOR ADAPTING A TOOTHBRUSH HOLDER TO PROVIDE ASSURANCE OF ITS HYGIENE

This application claims the priority date of a Provisional Patent Application filed on Jul. 31, 2001 (Ser. No. 60/309,066) which is herein incorporated, by reference, in its entirety.

FIELD OF THE INVENTION

The present invention is in the field of toothbrush holders and in particular disposable or limited use toothbrush holders designed or dispensed for use for a limited duration, for example, in a hotel or in a hospital bathroom or similar limited duration applications.

BACKGROUND OF THE INVENTION

A survey of the art reveals a variety of designs of toothbrush holders. Some of those designs feature the ornamental aspects of toothbrush holders. Examples of such omamentally-designed toothbrush holders are shown in U.S. Patent Nos. Des. 65,892, Des. 148,431, Des. 176,162, Des. 215,100, Des. 250,305, Des. 278,777, Des. 306,811 Des. 320,123 and Des. 425,349 which are hereby incorporated, in this application, by reference. Other designs feature the utility and functional aspects of toothbrush holders. Examples of such toothbrush holders are shown in U.S. Pat. Nos. 1,356,487, 1,487,085, 1,551,434, 2,642,999, 2,916,155, 2,917,182, 3,002,630, 4,008,808, 4,488,327, 4,607,752, 4,979,708, 5,259,519, and 5,996,816 which are also hereby incorporated, in this application, by reference.

With the exception of U.S. Pat. No. 3,002,630 issued to Heisser, none of the above prior art references show or suggest any means for assuring the hygiene of the toothbrush holder. Heisser teaches a suspension-type two-component toothbrush rack in which a plate 7, which is adhesively secured on a wall, is suitably-shaped to receive a disposable removably-mounted holder 13 which has slots or openings 18 for receiving and holding the toothbrush. It also covers the openings or slots 18, through which the toothbrush is suspended, with a removable protective strip 20, as shown in FIGS. 1 and 5 in U.S. Pat. No. 3,002,630. Removable protective strip 20 is made of suitable material, preferably tissue paper, which is adhesively secured on holder 13 or, in the case of waxed cardboard holder, is heat-pressed into the wax on one side of the holder, thereby covering openings or slots 18. A drawback of Heisser's toothbrush rack is that securing protective strip 20 on holder 13 requires an additional assembly step and, therefore, is more costly to produce in comparison to the toothbrush holders of the present invention.

For the purpose of this application, the term "hygiene", in addition to its accepted meaning of the science of health and the prevention of disease, is also used, herein, to mean no potential contamination which might be caused, generated or left by a previous user. Also, for the purpose of this application, the terms "assuring or assurance of the hygiene of the toothbrush holder" refer to and mean positively indicating to the first user of the toothbrush holder that the toothbrush holder has never been used, for its intended purpose, by another previous user.

Examination of the above-referenced prior art also shows that none of the prior art references show or suggest a low cost toothbrush holder which can accept and hold in place virtually all sizes of toothbrushes, including toothbrushes with thick or thin handles, large or small bristle heads and long and short handles.

The present invention addresses the above-mentioned deficiencies and provides low cost solutions for same. In addition to teaching a disposable toothbrush holder having the ability to receive and hold a toothbrush of virtually any practical size, it also teaches a low cost means and a method for positively assuring the hygiene of a toothbrush holder. Also, the method, disclosed herein, is adaptable to virtually all toothbrush holders of the prior art as will be described in the section of Detailed Description of the Invention

BRIEF DESCRIPTION OF THE DRAWINGS

FIG. 1 shows an isometric view of a suspension-type two-component disposable toothbrush holder assembly, FIG. 2 shows an isometric view of a suspension-type disposable toothbrush holder adapted in accordance with the present invention, FIG. 3 shows an isometric view of an open-receptacle counter-top type disposable toothbrush holder, FIG. 4 shows an isometric view of a closed receptacle counter-top type disposable toothbrush holder, and FIG. 5 shows an isometric view of another open-receptacle countertop embodiment of disposable toothbrush holder.

DETAILED DESCRIPTION OF THE INVENTION

FIG. 1 shows a suspension-type two-component disposable toothbrush holder assembly 1. It comprises two structurally-separate components, namely; a bracket 5 and a disposable holder 2. As shown in FIG. 1, bracket 5 is suitably shaped to be directly attached to vertical wall 10 and to provide space for receiving and securing in place disposable holder 2. This is accomplished by incorporating two integrally-connected segments 5-*a* and 5-*b* in bracket 5. First segment 5-*a* provides a contact surface for mounting bracket 5 on vertical wall 10 whereas second segment 5-*b*, being spaced away from segment 5-*a*, as shown in FIG. 1, provides space between itself and vertical wall 10 for receiving vertical wall segment 6 of disposable holder 2. Thus, disposable holder 2 is secured in place by sliding its vertical wall segment 6 behind second segment 5-*b*, of bracket 5, as shown in FIG. 1. After use, disposable holder 2 is removed by sliding vertical wall segment 6 horizontally and away from bracket 5 and a new disposable holder 2 is similarly placed and secured in position.

Bracket 5 may be attached to vertical wall 10, permanently or temporarily, by permanent adhesive or permanent adhesive double-sided adhesive tape, removable or temporary pressure-sensitive adhesive or double-sided adhesive tape, mechanical fasteners such as screws through holes 20, magnetically or by other means known in the art such as suction cups.

Also, as shown in FIG. 1, a unitary-structure rigid disposable holder 2 comprises at least two rigidly and integrally-connected segments; vertical wall segment 6 which extends upwardly and is integrally-connected to horizontal platform segment 7. Optionally, disposable holder 2 may also comprise a splash guard 21. Vertical wall segment 6 and platform 7 are also rigidly-connected to one another and do not rotate, move or collapse relative to one another.

For the purpose of this invention, the terms "integrally-connected components or segments", "integral bond", "integral connection" and "integrally-bonded or joined components or segments" shall mean that the connected, joined or bonded components or segments have a cohesive or same-material continuity between them provided also that such a cohesive or same-material continuity may be severed, broken, discontinued or destroyed only irreversibly, i.e., destructively, thereby providing an indication that the integral connection, bond or assembly has been irreversibly damaged. The term cohesive continuity refers to a mass continuity generated at the interface of two, initially-separate, components or segments as a result of a welding action whether such a welding action is between two metallic or two polymeric components or segments. Accordingly, examples of integrally-bonded joined or connected components or segments are parts of a unitary structure formed by injection molding, thermoforming, compression molding, casting, rotational molding, hot forming or forging, cold forming or forging, blow molding or extrusion. Additional examples include heat, ultrasonically, friction, induction-heat and vibration welded segments or components. Also, accordingly, examples of non-integrally-bonded, joined or connected components or segments are parts of a structure that are readily removable or pushed out, heat-pressed in wax, adhesively-bonded or fastened together by mechanical fasteners such as bolts and nuts, screws or rivets.

Advantages of integrally-connecting, joining or bonding the components or segments of the toothbrush holder of the present invention, and in particular its hygiene assurance member, include the positiveness of hygiene assurance since the components are more securely held together and only irreversibly severable, rather than being merely replaceable, left in place or readily removable or pushed through. Additional advantages include lower manufacturing cost since no adhesives or adhesive tapes are used for covering the opening which receives and holds the toothbrush.

Bracket 5 and disposable holders 2 and 11 may be made from a variety of materials and preferably plastics materials for lower cost and ease of manufacturing. They may also be manufactured by a variety of methods, mentioned earlier, and preferably by injection molding or thermoforming.

Disposable holder 2 has at least one receptacle 3 which receives and holds, in a suspended position, toothbrush 9 through its opening 8, as shown in FIG. 1. As shown therein, toothbrush handle 9-*a* is passed through opening 8, which is smaller than toothbrush head 9-*b* and toothbrush bristles 9-*c*, thus holding toothbrush 9 in a suspended position.

FIG. 2 shows a disposable toothbrush holder 11 of the suspension-type, which is similar to holder 2 described earlier but, adapted in accordance with the present invention, for positive assurance of its hygiene. As shown therein, a unitary structure rigid disposable holder 11 comprises rigidly and integrally-connected vertical wall segment 12 and horizontal platform segment 13. Platform 13 includes receptacles 14 and 15 as adapted in accordance with the present invention. Receptacles 14 and 15 may receive and hold a toothbrush, in a suspended position, only after integrally-connected hygiene assurance element or membrane 16 is irreversibly removed or punctured by the first user. Hygiene assurance element or membrane 16 covers, at least partially, opening 18 in receptacle 14 prior to being irreversibly removed or punctured by the first user. Receptacle 15, however, depicts its corresponding opening 18-A after its corresponding hygiene assurance element was irreversibly removed by its first user.

Hygiene assurance element or membrane 16 is integrally-connected to at least a portion of the perimeter of opening 18 at integral connection zone 17, thereby integrally connecting hygiene assurance element 16 to platform 13. Zone 17 provides a cohesive or same-material continuity between element 16 and platform 13. Zone 17 also provides an irreversible failure line 19 which provides a positive indication and assurance of the hygiene of the toothbrush holder to its first user.

When element 16 is deformed by a first user upwards, downwards or generally in a manner that generates a strain in zone 17, which exceeds the maximum strain that zone 17 can sustain, an irreversible failure takes place in zone 17, preferably along irreversible failure line 19, thus destroying irreversibly the integral continuity or bond between element 16 and platform 13 and thus positively assuring the first user of the hygiene of the holder.

Element 16 may also be designed to be irreversibly torn away from platform 13 by tearing integral connection zone 17 along line 19. Line 19 may also be rendered a weakened tear line or, more generally, a frangible or weakened-strength line by having indentation(s), perforation(s), hole(s) or generally reduced cross-sectional area such that any attempt to break element 16, away from platform 13, results in an irreversible failure taking place along line 19.

In the above described embodiment, element 16 may also be referred to as a breakaway tab.

Alternatively, element 16 may be designed in the form of a thin irreversibly pierceable or tearable membrane, which may be integrally-bonded to perimeter of opening 18 or surface of platform 13.

Element 16 covers at least a portion of opening 18 and thus prevents or interferes with placing toothbrush handle 9-*a* through it. Upon being irreversibly ruptured, punctured, broken, torn, damaged or removed by the first user, it provides an indication and a positive assurance of the hygiene of the toothbrush holder to its first user and allows a toothbrush to be received and held, in a suspended-position, in opening 18.

The terms "irreversibility" and "irreversibly", in the context of this invention, mean the inability to restore the state of the hygiene assurance element and/or the failure zone to their state(s) prior to being ruptured, punctured, broken, torn, damaged or removed.

The embodiments shown in FIGS. 1 and 2 also describe and teach a method for positively assuring the hygiene of a suspension-type toothbrush holder and for adapting any toothbrush holder of the prior art to provide positive assurance of its hygiene to its first user. The method comprises the steps of 1) providing a toothbrush holder having a platform, said platform having at least one receptacle, said receptacle having an opening, said opening being smaller than a toothbrush head, and 2) providing a positive hygiene assurance element, said hygiene assurance element being integrally-connected to said platform and covering, at least partially, said opening such that said hygiene assurance element prevents or interferes with the insertion of or placing a toothbrush into said opening until said hygiene assurance element is irreversibly ruptured, punctured, broken torn, damaged or removed in order to allow said toothbrush to be received and held in said receptacle, thereby providing a positive assurance of the hygiene of said toothbrush holder to its first user.

FIG. 3 shows a counter-top type single-component toothbrush holder 25 in accordance with the present invention. An advantage of the counter-top embodiment is that it can be placed directly on the top surface of a counter or a dresser in a bathroom, as a free-standing unit, and thus does not require a mounting bracket or fastening onto a wall as the suspension-type embodiment shown in FIGS. 1 and 2.

Another advantage of the embodiment shown in FIG. 3 is that it can receive and hold, in a stable equilibrium position, virtually any practical size toothbrush.

As shown in FIG. 3, a unitary-structure rigid toothbrush holder 25 comprises a base 26 which is adapted to be placed on a flat or a substantially horizontal surface. Base 26 is rigidly and integrally-connected to an elevator member 27, which extends upwardly or substantially vertically from base-to-elevator section 28 and carries cavity or receptacle member 29. Member 29 comprises at least one of open type receptacles 30-A and 30-B, open-type openings 31-A and 31-B and hygiene assurance elements 32-A and 32-B (shown in phantom line). Hygiene assurance element 32-A is integrally-connected to receptacle member 29 through integral connection zone 33, in a manner similar to that performed by integral connection zone 17 discussed earlier in connection with platform 13 and hygiene assurance element 16, shown earlier in FIG. 2.

As shown in FIG. 3, receptacle 30-A depicts the construction of the toothbrush holder before the irreversible removal of hygiene assurance element 32-A. Receptacle 30-B, however, shows opening 31-B with its hygiene assurance element 32-B (not shown) removed and toothbrush 9 placed, in a stable equilibrium inclined orientation, with its base resting against an inside surface of stop 34 and its handle inclined at an angle<90. The stop 34 can have a front wall which is flanked by a pair of sidewalls joined to the front wall.

Since the embodiment shown in FIG. 3 has open type receptacles 30-A and 30-B and open type openings 31-A and 31-B, virtually any practical size toothbrush can be received and held in openings 31-A or 31-B.

Disposable holder 25 may be made from a variety of materials and preferably plastics materials for lower cost and ease of manufacturing. It may also be manufactured by a variety of methods, mentioned earlier, and preferably by injection molding or thermoforming.

As shown in FIG. 3, receptacles 30-A or 30-B may receive and hold a toothbrush only after their corresponding integrally-connected hygiene assurance element 32-A or 32-B are irreversibly removed by the first user of the toothbrush holder, thus providing a positive assurance of the hygiene of the toothbrush holder to its first user. Hygiene assurance element or membrane 32-A covers, at least partially, opening 31-A in receptacle 30-A prior to being irreversibly ruptured, punctured, broken, torn, damaged or removed by the first user. Receptacle 30-B, however, depicts its corresponding opening 31-B after its corresponding hygiene assurance element was irreversibly removed by the first user of the toothbrush holder.

Hygiene assurance element or membrane 32-A is integrally-connected to at least a portion of the perimeter of opening 31-A at integral connection zone 33-A, thereby integrally connecting hygiene assurance element 32-A to cavity or receptacle member 29. Zones 33-A and 33-B provide a cohesive or same-material continuity between elements 32-A and 32-B and receptacle member 29. Zones 33-A and 33-B also provide irreversible failure lines 35-A and 35-B which provide a positive indication and assurance of the hygiene of the toothbrush holder to its first user.

When element 32-A is deformed by a first user upwards, downwards or generally in a manner that generates a strain in zone 33-A, which exceeds the maximum strain that zone 33-A can sustain, an irreversible failure takes place in zone 33-A, preferably along irreversible failure line 35-A, thus destroying irreversibly the integral continuity or bond between element 32-A and member 29 and thus positively assuring the first user of the hygiene of the holder.

Element 32-A may also be designed to be irreversibly torn away from member 29 by tearing integral connection zone 33-A along line 35-A. Line 35-A may also be rendered a weakened tear line or, more generally, a frangible or weakened-strength line by having indentation(s), perforation(s), hole(s) or generally reduced cross-sectional area such that any attempt to break element 32-A, away from member 29, results in an irreversible failure taking place along line 35-A.

In the above described embodiment, elements 32-A and 32-B may also be referred to as breakaway tabs.

Alternatively, element 32-A may be designed in the form of a thin irreversibly pierceable or tearable membrane, which may be integrally-bonded to perimeter of opening 31-A or surface of member 29.

Element 32-A covers at least a portion of opening 31-A and thus prevents or interferes with placing a toothbrush in toothbrush holder 25. Upon being irreversibly ruptured, punctured, broken, torn, damaged or removed by the first user, it provides an indication and a positive assurance of the hygiene of the toothbrush holder to its first user and allows a toothbrush to be received and held in disposable toothbrush holder 25.

In accordance with the present invention, holder 25 may also be designed such that angle be equal to zero, i.e., toothbrush 9 would be held in a horizontal position. In such an embodiment, stop 34 would not be necessary and receptacles 30-A and 30-B would be modified to provide support zones, within which the center of gravity of the toothbrush is contained.

The embodiments shown in FIGS. 3, 4 and 5 also describe and teach a method for positively assuring the hygiene of a counter-top type toothbrush holder and for adapting any toothbrush holder of the prior art to provide positive assurance of its hygiene to its first user. The method comprises the steps of 1) providing a toothbrush holder having a cavity or receptacle member, said member having at least one receptacle, said receptacle having an opening, and 2) providing a positive hygiene assurance element, said hygiene assurance element being integrally-connected to said member and covering, at least partially, said opening such that said hygiene assurance element prevents or interferes with receiving and holding a toothbrush into said opening until said hygiene assurance element is irreversibly ruptured, punctured, broken, torn, damaged or removed in order to allow said toothbrush to be received and held in said receptacle, thereby providing a positive assurance of the hygiene of said toothbrush holder to its first user.

FIG. 4 shows a counter-top type toothbrush holder 40, which is similar to toothbrush holder 25 shown in FIG. 3, except for having closed-type receptacles 45-A and 45-B and closed-type openings 46-A and 46-B.

FIG. 5 shows another embodiment of a counter-top type single-component toothbrush holder 60, in accordance with the present invention, which may be placed directly on a horizontal surface. As shown therein, toothbrush holder 60 is a unitary-structure which comprises a base member 61 which, in use, is of a substantially horizontal orientation. At one end, base member 61 joins base-to-elevator section 63 which, in turn, joins elevator section 62. Base member 61 has spacers 70 on its underside in order to prevent direct contact between base member 61 and the surface on which toothbrush holder 60 is placed. Base member 61 also has drainage holes 72.

Elevator section 62 has cavity or receptacle member 64 which comprises open-perimeter type receptacles 65-A and 65-B which have openings 66-A and 66-B. As shown in FIG. 5, opening 66-A is partially covered with hygiene assurance member 67-A which provides a temporary and irreversibly-removable interference with a first user's ability to place a toothbrush in opening 66-A and against an inside surface thereof of receptacle 65-A. Hygiene assurance member 67-A is integrally-connected or bonded to cavity or receptacle member 64 at integral connection zone 68-A. Integral connection zone 68-A provides a cohesive or same-material continuity between receptacle member 64 and hygiene assurance member 67-A. It also provides an irreversible failure line 80 which provides a positive indication and assurance of the hygiene of the toothbrush holder to its first user. It is worth noting here that receptacle member 64, receptacles 65-A and 65-B, openings 66-A and 66-B, hygiene assurance members 67-A and 67-B, integral connection zones 68-A and 68-B and failure lines 80 are similar in nature, function, mode of operation, location, dimensions, material choices, manufacturing method choices and all other relevant respects to their respective equivalent components shown in FIGS. 1, 2, 3 and 4.

As shown in FIG. 5, receptacle 65-B is shown with its hygiene assurance member 67-B (not shown), which is similar to hygiene assurance member 67-A, irreversibly removed or broken, thus permitting toothbrush 9 to be placed in opening 66-B of receptacle 65-B with one of its ends 9-*a* resting against stop 69-B and the other end 9-*b* surrounded by receptacle 65-B. An advantage of this embodiment is that it can be used to receive and hold a toothbrush of virtually any practical size. It is also worth noting that receptacles 65-A and 65-B are of a nearly vertically-oriented three-dimensional U shape while hygiene assurance members 67-A and 67-B are of a nearly horizontal-orientation two-dimensional configuration and cover openings 66-A and 66-B only in a partial manner, yet provide a sufficient interference that prevents a toothbrush from being received in openings 66-A or 66-B. In accordance with the present invention, the shape, size and location of hygiene assurance member can be varied, including being of a three-dimensional configuration, to provide a greater or lesser amount of coverage of opening 66-A as long as the hygiene assurance member provides sufficient interference that prevents a toothbrush from being received and held in the toothbrush holder. Also, cavity or receptacle member 64 may be configured so that integral connection zones 68-A and 68-B may be located at a higher or a lower point, or any other location than as shown in FIG. 5. For example, hygiene assurance member 67-A may be integrally connected to section 72, 73 and/or 74. When hygiene assurance member 67-A is pushed up or down or generally deformed by the first user so that the strain generated in zone 68-A exceeds its breaking strain, an irreversible failure occurs in zone 68-A and member 67-A is removed or irreversibly deflected upwards or downwards by the first user thus making it possible to allow toothbrush 9 to be received in a receptacle, for example in receptacle 65-B as shown in FIG. 5.

Alternatively, hygiene assurance members 16, 32A and 32-B, and 67-A and 67-B may be made in the form of a thin membrane integrally connected to the perimeters of their respective receptacles. Such thin membranes would be irreversibly ruptured, punctured, broken, torn, damaged or removed by a first user, thus assuring the hygiene of the toothbrush holder to its first user.

As shown in FIG. 5, angle is substantially smaller than 90. It should also be understood that angle can be equal to zero by raising the level of rests 69-A and 69-B and/or by lowering the level of lower end 74 of receptacles 65-A and 65-B.

Alternatively, the toothbrush holders described in this invention may be wrapped individually in sealed bags in order to assure the user of their hygiene. In this case, the toothbrush holder does not have to, but may optionally, include a hygiene assurance member.

The toothbrush holders disclosed in this application may be made of a variety of materials including plastics materials, metals, water-resistant fibrous materials. They may also be made by injection molding, thermoforming, compression molding, hot or cold stamping, rotational molding, blow molding, forging, casting or other production methods known in the art.

While what have been described in this application are certain specific embodiments of the present invention, it is possible to conceive of or design many other alternative embodiments, whether of ornamental or functional nature, of the present invention without departing from the spirit and scope of the invention.

What is claimed is:

1. A toothbrush holder comprising:

a base member having a substantially horizontal orientation, a base-to-elevator section is joined to a first end of said base member, said base-to-elevator section is joined to an elevator section at a first end of said elevator section, said elevator section having a receptacle at a second opposite end thereof, said receptacle being of a substantially horizontal orientation and having at least one opening therein that is adapted to receive a toothbrush therein, whereby said opening has a closed end adjacent said elevator section and an opened end that extends forwardly and away from said elevator section, said base member having an upwardly extending stop at a second opposite end thereof whereby said stop has a front wall and side walls joined thereto, said base member, said base-to-elevator section, said elevator section, and said receptacle being integrally and rigidly formed from one-piece of material, whereby when a toothbrush is placed in an inclined orientation in said at least one opening, one of its ends rests against an inside surface of said stop and in between the walls thereof and the other end of the toothbrush rests against an inside surface of the opening.

2. The toothbrush holder according to claim 1 wherein said receptacle further comprises a hygiene assurance element.

3. The toothbrush holder according to claim 2 wherein said hygiene assurance element being integrally connected to at least a portion of the perimeter of said at least one opening.

4. The toothbrush holder according to claim 1 wherein said toothbrush holder being made by injection molding.

5. The toothbrush holder according to claim 1 wherein said toothbrush holder being made by thermoforming.

* * * * *